United States Patent [19]

Kume et al.

[11] 4,336,609

[45] Jun. 22, 1982

[54] DIGITAL INPUT MEANS FOR MINIATURE TYPE ELECTRONIC DEVICES

[75] Inventors: Kazunari Kume; Sizuo Yamaguchi, both of Saitama, Japan

[73] Assignee: Citizen Watch Co., Ltd., Tokyo, Japan

[21] Appl. No.: 252,226

[22] Filed: Apr. 8, 1981

Related U.S. Application Data

[63] Continuation of Ser. No. 87,500, Oct. 23, 1979, abandoned.

[30] Foreign Application Priority Data

Dec. 6, 1978 [JP] Japan ..... 53-151382

[51] Int. Cl.[3] ..... G04C 9/00

[52] U.S. Cl. ..... 368/188

[58] Field of Search ..... 368/69, 70, 85-86, 368/155, 156, 185-190, 206, 217, 218, 308, 319-321; 328/60, 61

[56] References Cited

U.S. PATENT DOCUMENTS

| | | | |
|---|---|---|---|
| 3,943,696 | 3/1976 | Portmann | 368/189 |
| 4,091,612 | 5/1978 | Meisner et al. | 368/155 |
| 4,209,976 | 7/1980 | Flumm | 368/187 |
| 4,222,010 | 9/1980 | Meisner et al. | 360/188 X |
| 4,246,650 | 1/1981 | Moritani et al. | 368/69 |

OTHER PUBLICATIONS

"Electronic Circuit Design Hand Book", Tab Books, Blue Ridge Summit, Pa., 5/71, p. 224.

*Primary Examiner*—Vit W. Miska

*Attorney, Agent, or Firm*—Bernard, Rothwell & Brown

[57] ABSTRACT

A digital input means for miniature type electronic devices comprising an external actuator, mechano-electrical converter and circuit means. The mechano-electrical converter is excited to deliver an output signal which is then supplied to the circuit means and the circuit is operative in response to the operation of the external actuator to deliver an output signal.

2 Claims, 10 Drawing Figures

DIGITAL INPUT MEANS FOR MINIATURE TYPE ELECTRONIC DEVICES

This is a continuation of application Ser. No. 087,500 filed Oct. 23, 1979, now abandoned.

BACKGROUND OF THE INVENTION

1. Field of the Invention

This invention relates to a digital input means for miniature type electronic devices such as an electronic timepiece or the like and more particularly to a data input construction which makes use of a mechano-electrical converter element such as a piezoelectric element or the like.

2. Description of the Prior Art

In a miniature type electronic device such as an electronic timepiece or the like having a digital display, a so-called select and set system has heretofore been proposed. In such system, a push button as an external actuator member is operated to supply data as an input for the purpose, for example, of setting hour and minute. Meanwhile, a so-called winding stem type input system has also been known which makes use of a winding stem as an external actuator element so as to rotate it for the purpose of continuously correcting hour and minute.

However, the former select and set system is rather troublesome in operation for those skilled in correcting a conventional needle type timepiece, that is, a conventional analogue timepiece. The latter winding stem type input system has been developed in order to eliminate the drawback which has been encountered with the former select and set system. But, this winding stem input system has the disadvantage that leftward rotating direction and rightward rotating direction of the winding stem must be detected so as to effect plus correction or minus correction, thereby requiring complex contacts, that it is impossible to make small in space, that adjustment becomes complex, that it is not reliable in operation and that it is difficult to apply it to a wrist watch.

SUMMARY OF THE INVENTION

A main object of the invention, therefore, is to provide a digital input means which can eliminate the above mentioned drawbacks which have been encountered with the prior art techniques.

Another object of the invention is to provide a digital input means which is extremely simple in construction, in in thickness, and small and compact in size.

A further object of the invention is to provide a digital input means which does not require any assembling and adjusting means.

A still further object of the invention is to provide a digital input means which can reduce the number of lead wires and has no mechanical contact.

Another object of the invention is to provide a digital input means which can completely discriminate input signals one from the other.

A further object of the invention is to provide a digital input means which can eliminate any unrequired signal such as a chattering signal or the like to be produced when a switch is operative.

A feature of the invention is the provision of a digital input means for miniature type electronic devices comprising (a) an oscillator circuit for generating a reference signal;

(b) a frequency divider circuit for generating a unit signal from said reference signal delivered from said oscillator circuit;

(c) a data holding circuit means for generating a driving signal from said unit signal delivered from said frequency divider circuit;

(d) an electro-optical display means for performing a digital display by means of said driving signal delivered from said data holding circuit means; and (e) a digital input means for supplying an input obtained from an external actuator through a mechano-electrical converter and a circuit means to said data holding circuit means.

Further objects and features of the invention will be fully understood from the following detailed description with reference to the accompanying drawings, wherein:

DETAILED DESCRIPTION OF THE PREFERRED EMBODIMENTS

Embodiments of the invention will be described in greater detail with reference to the drawings.

Figure 1:
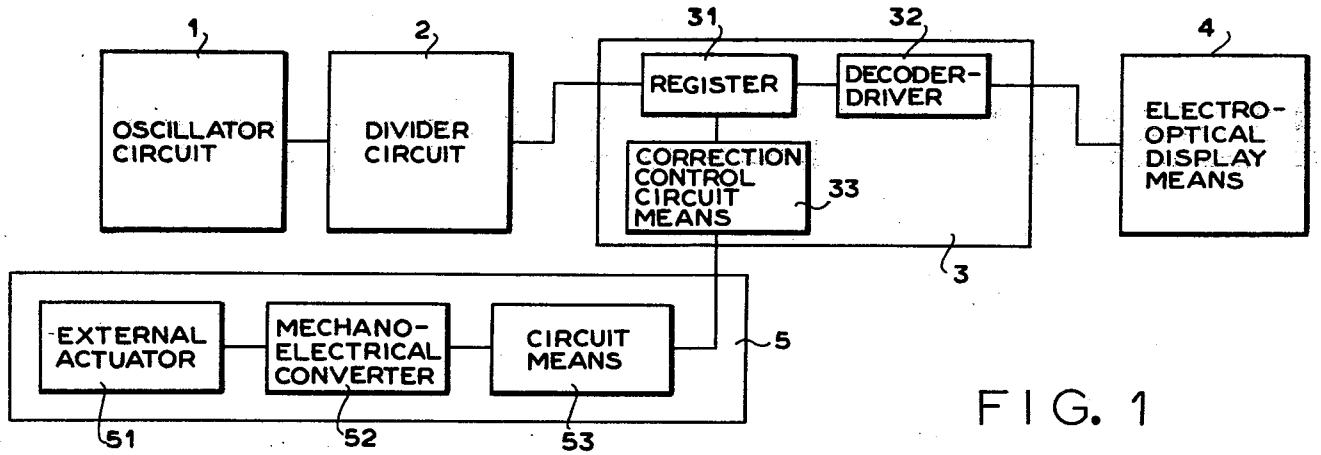
FIG. 1 is a block diagram of one embodiment of a digital input means according to the invention.

FIG. 1 is a block diagram of an electronic timepiece embodying the invention. In FIG. 1, reference numeral 1 designates an oscillator circuit including a quartz oscillator. The oscillator circuit 1 is operative to generate a time reference signal which is high in frequency, for example, a signal having a frequency of 32768 Hz. The output signal delivered from the oscillator circuit 1 is supplied to a frequency divider circuit 2. The frequency divider circuit 2 functions to divide the frequency of the output from the oscillator circuit 1 to form a unit time signal.

The present embodiment constitutes the simplest digital electronic timepiece in which the frequency divider circuit 2 functions to deliver an output signal having a frequency of 1 Hz which is supplied to a data holding circuit means 3. The data holding circuit means 3 includes a register 31 for accumulating data of hour, minute, second. The register 31 is operative to memorize the number of the output signals from the frequency divider circuit 2 so as to hold the time data. The content of the register 31 is supplied through a decoder-driver 32 to an electro-optical display means 4 which displays by means of a liquid crystal display cell, for example.

Meanwhile, a digital input means 5 is composed of an external actuator 51, a mechano-electrical converter 52 and a circuit means 53 and used when the content of the register 31 of the data holding circuit means 3, for example, is desired to be rewritten.

In the present embodiment, as the external actuator 51, use is made of a winding stem 511 and as the mechano-electrical converter 52, use is made of a piezoelectric element 521.

Figure 2:
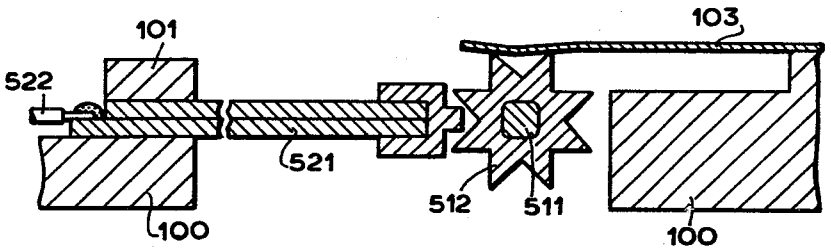
FIG. 2 is a cross-sectional view of essential parts of a digitial input means according to the invention.

FIG. 2 shows an example of a concrete arrangement of the winding stem 511 and piezoelectric element 521 in section. The piezoelectric element 521 is secured to a substrate 100 by means of a holding plate 101. Meanwhile, to the winding stem 511 is secured a driving ratchet wheel 512 which serves to exert a force to the piezoelectric element 521 when the winding stem 511 is rotated in left or right direction. To the substrate 100 is secured a click spring 103 which engages with the driving ratchet wheel 512 so as to determine the position thereof.

In the case of rewriting the content of the register 31 of the data holding circuit means 3, if the winding stem 511 (the external actuator 51) is pulled out and rotated, the driving ratchet wheel 512 secured to the winding stem 511 causes the piezoelectric element 521 (the mechano-electrical converter 52) to be driven. The piezoelectric element 521 generates an electric signal when it is subjected to the mechanical displacement. The electric signal is supplied to the circuit means 53. In the circuit means 53, the electric signal arrived thereat functions to discriminate whether the winding stem 511 is rotated in the right direction or in the left direction, thereby transmitting a precise positive direction correction signal or negative direction correction signal to a correction control circuit means 33 of the data holding circuit means 3. If the correction control circuit means 33 receives the signal delivered from the circuit means 53, the correction control circuit means 33 functions to select the direction to be corrected (positive direction or negative direction) so as to rewrite the content of the register 31.

Figure 3:
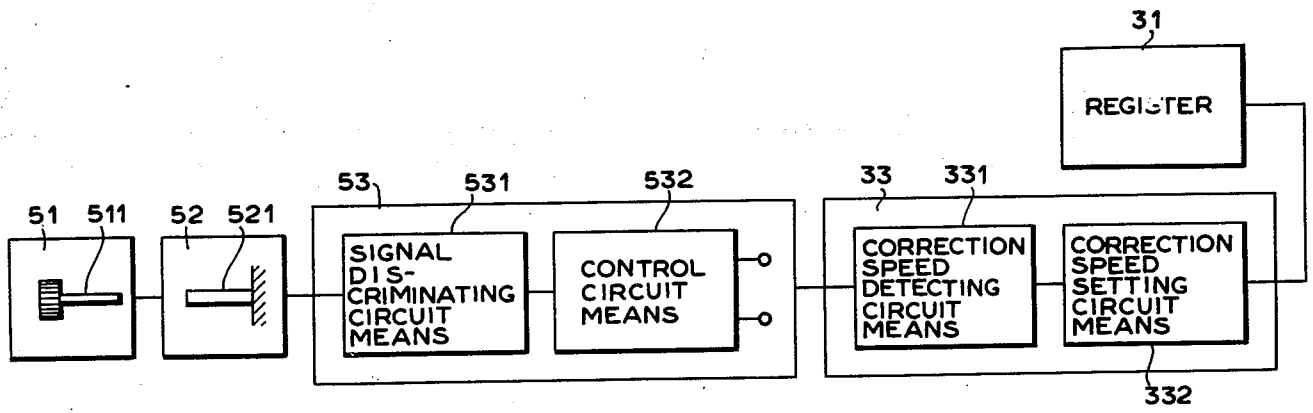
FIG. 3 is a detailed block diagram of a part of the embodiment shown in FIG. 1.

FIG. 3 is a detailed block diagram of the circuit means 53 and correction control circuit means 33 shown in FIG. 1.

The circuit means 53 is composed of a signal discriminating circuit means 531 and control circuit means 532. The correction control circuit means 33 is composed of a correction speed detecting circuit means 331 and a correction speed setting circuit means 332.

The signal discriminating circuit means 531 receives the output signal from the piezoelectric element 521 so as to discriminate whether the winding stem 511 is rotated in the right direction or in the left direction and the signal thus obtained is supplied through branch signal lines to the control circuit means 532. The control circuit means 532 functions to judge the signal on each of the branch signal lines and completely divide the signal into the branch lines.

If the signals thus branched (one of the signals is correction in the positive direction and the other signal is correction in the negative direction) are supplied to the correction speed detecting circuit means 331 which functions to measure the interval between successive input pulses and the result thus measured is delivered to the correction speed setting circuit means 332 which functions to supply a correction pulse to the register 31 in response to the divided direction of the circuit means 53 and output signal from the correction speed detecting circuit means 331.

Figure 4:
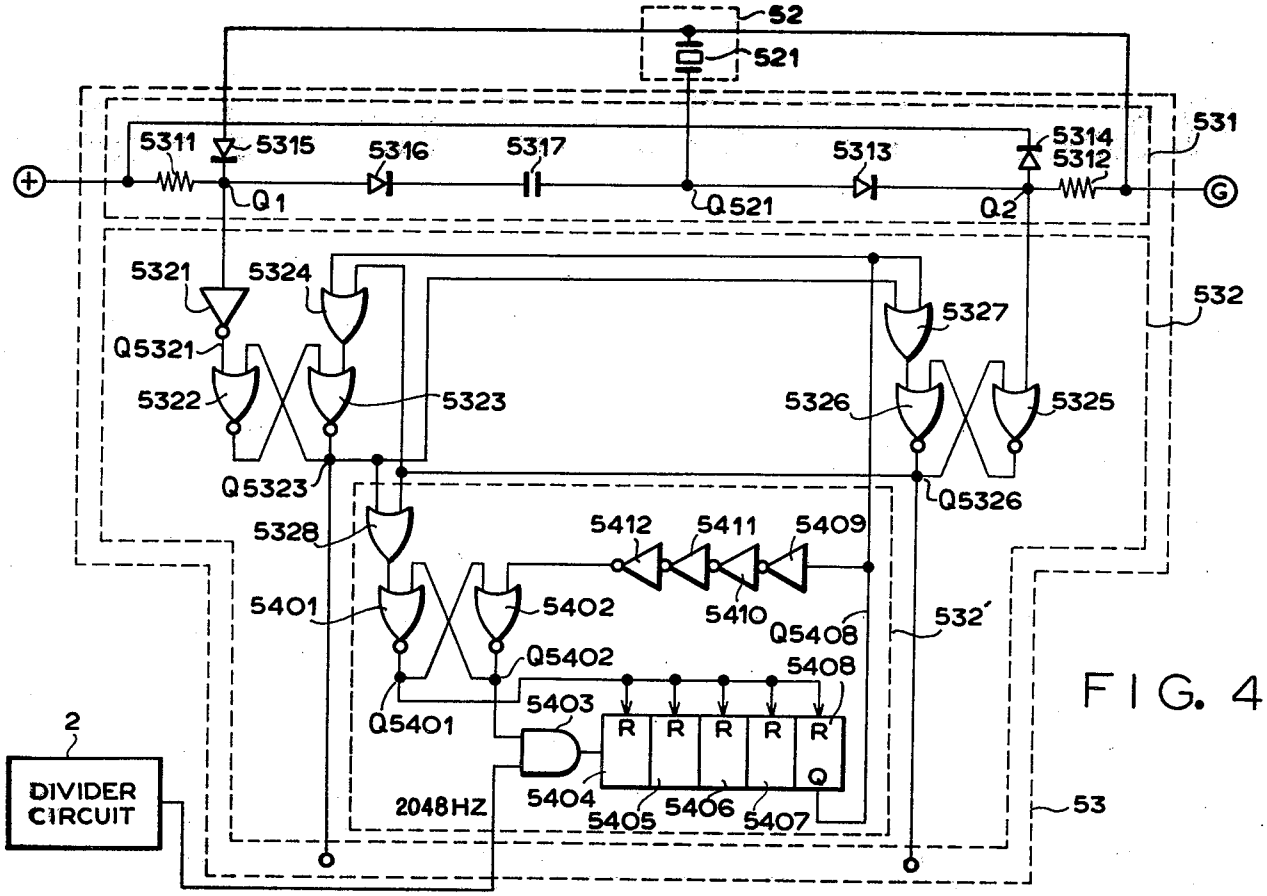
FIG. 4 is a circuit diagram of concrete construction of the circuit means shown in FIG. 1.
Figure 5A:
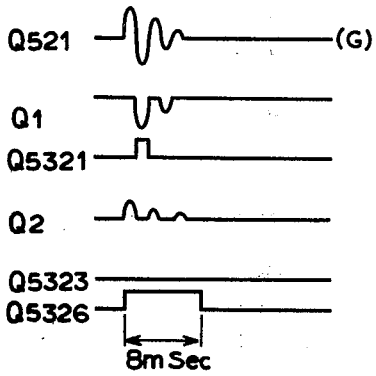
FIGS. 5A, 5B and 5C are timing charts showing signals at various points of the circuit diagram shown in FIG. 4.
Figure 5B:
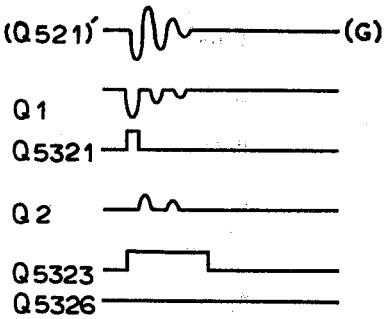
Figure 5C:
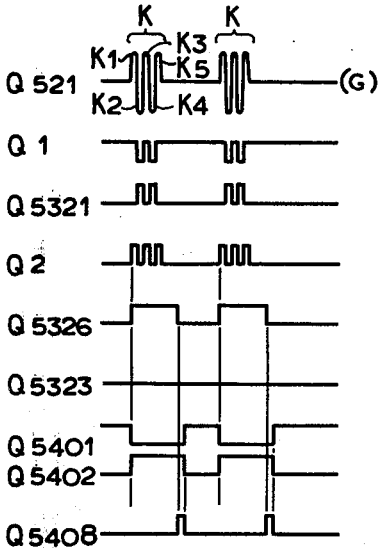

FIG. 4 is an example of a concrete circuit showing the content of the circuit means 53 shown in FIGS. 1 and 3. FIGS. 5A to 5C are wave form diagrams showing operative output signals at various points of the circuit shown in FIG. 4.

In the first place, the circuit construction shown in FIG. 4 will be described and secondly the circuit operation will be described with reference to the wave form diagrams shown in FIGS. 5A to 5C.

FIG. 4 shows the circuit means 53 and the piezoelectric element 521 as the mechano-electrical converter 52.

As shown in FIG. 3, the circuit means 53 is composed of the signal discriminating circuit means 531 and the control circuit means 532 connected to the output side thereof. The control circuit means 532 includes a timer circuit means 532' for removing an undesired signal which produces chattering or the like when the control circuit means 532 is operative.

One of the terminals of the piezoelectric element 521 is coupled to a line between one of the terminals of a diode 5313 for constituting the signal discriminating circuit means 531 and one of the terminals of a blocking condenser 5317 for constituting the signal discriminating circuit means 531. The other terminal of the diode 5313 is coupled to one of the terminals of a diode 5314 and to one of the terminals of a resister 5312. The other terminal of the resister 5312 is coupled to the ground Ⓖ on the one hand and coupled to the other terminal of the piezoelectric element 521 and to one of the terminals of a diode 5315 on the other hand. The other terminal of the diode 5315 is connected through a diode 5316 to the other terminal of the blocking condenser 5317 and connected through a resistor 5311 to a plus electric source ⊕. In addition, the resistor 5311 is connected to the other terminal of the diode 5314. In the signal discriminating circuit means 531, the diodes 5315, 5316 and the diodes 5313, 5314 constitute rectifier circuits, respectively.

To a coupled point between the resistor 5311 and the diodes 5315, 5316 is connected an input terminal of an inverter 5321 of the control circuit means 532. An output terminal of the inverter 5321 is connected to one of input terminals of a NOR gate 5322. A pair of the NOR gate 5322 and a NOR gate 5323 constitute a RS flip-flop (hereinafter will be abbreviated as RS-FF) circuit. An output terminal of the NOR gate 5323 is connected to the correction control circuit means 33 (FIGS. 1 and 3) on the one hand and connected to one of the input terminals of an OR gate 5327 and one of the input terminals of an OR gate 5328 of the timer circuit means 532' on the other hand.

To a junction point between the resistor 5312 of the signal discriminating circuit means 531 and the diodes 5313 and 5314 of the signal discriminating circuit means 531 is coupled one of the input terminals of a NOR gate 5325 of the control circuit means 532. A pair of the NOR gate 5325 and a NOR gate 5326 constitute RS-FF circuit. The output terminal of the NOR gate 5326 is connected to the correction control circuit means 33 (FIGS. 1 and 3) and to one of the input terminals of the OR gate 5324 and to one of the input terminals of the OR gate 5328 of the timer circuit 532' to be described later. The output terminals of the OR gate 5324 and 5327 are coupled to one of the input terminals of the NOR gate 5323 and to one of the input terminals of the NOR gate 5326, respectively.

The output terminal of the OR gate 5328 of the timer circuit 532' is connected to one of the input terminals of a NOR gate 5401. A pair of the NOR gate 5401 and a NOR gate 5402 constitute a RS-FF circuit. The output terminal of the NOR gate 5402 is connected to one of the input terminals of an AND gate 5403 and to the input terminal of which is applied a signal having a frequency of 2048 Hz from the intermediate stage of the frequency divider circuit 2 shown in FIG. 1. The output terminal of the AND gate 5403 is connected to a flip-flop circuit (which will hereinafter be abbreviated as FF) 5404. The FF5404 is connected in series with FF5405, FF5406, FF5407 and FF5408 to constitute a 5 stage counter. All of the reset terminals R of the FF5404 to 5408 are connected to the output terminal of the NOR gate 5401. The output terminal of the last stage FF5408 is connected to respective input terminals of the OR gates 5324 and 5327 and to the input terminal of an inverter 5409. To the output terminal side of the inverter 5409 are connected in series inverters 5410, 5411 and 5412 is succession. The output terminal of the last inverter 5412 is connected to one of the input terminals of the NOR gate 5402.

The circuit operation of the embodiment shown in FIG. 4 will now be described in greater detail with reference to the timing chart shown in FIGS. 5A to 5C.

As described above, in the apparatus constructed as shown in FIG. 2, if the winding stem 511 as the external actuator 51 is rotated in right direction or rotated in left direction, the driving ratchet wheel 512 secured to the winding stem 511 becomes operative to repel the piezoelectric element 521. In this case, a voltage wave produced from the piezoelectric element 521 when the driving ratchet wheel 512 repels it downwardly is different in form from a voltage wave produced from the piezoelectric element 521 when the driving ratchet wheel 512 repels it upwardly. FIGS. 5A and 5B show signals Q521 and (Q521)′ as examples of the above mentioned voltage wave forms, respectively. That is, FIGS. 5A and 5B show that the initial voltage is produced in the positive direction or in the negative direction in dependence with the rotation of the winding stem 511 in the right direction or in the left direction. In the present embodiment, if the winding stem 511 is rotated in the right direction, a positive signal Q521 (FIG. 5A) is obtained and if the winding stem 511 is rotated in the left direction, a negative signal (Q521)′ (FIG. 5B) is obtained.

If the winding stem 511 is rotated in the right direction so as to produce the signal Q521, an initial signal $Q_1$ at the output terminal of the inverter 5315 of the signal discriminating circuit means 531 becomes negative in polarity and an initial signal $Q_2$ at the input terminal of the inverter 5314 of the signal discriminating circuit means 531 becomes positive in polarity. The signal $Q_1$ is reversed in polarity by the inverter 5321 of the control circuit means 532 into a signal $Q_{5321}$ which is supplied to one of the input terminals of the NOR gate 5322. The other signal $Q_2$ is directly supplied to one of the input terminals of the NOR gate 5325 of the control circuit means 532. The signal $Q_2$ is directly supplied to the NOR gate 5325 in correspondence with the initial positive pulse of the signal $Q_{521}$ and hence is earlier in time than the signal $Q_{5321}$. As a result, the output signal $Q_{5326}$ from the NOR gate 5326 responding to the signal $Q_2$ becomes H at first. The "H" signal is applied through the OR gate 5324 to the NOR gate 5323, thereby holding the output signal $Q_{5323}$ from the NOR gate 5323 at L. As a result, the signal $Q_{5323}$ is held at L even when the signal $Q_{5321}$ becomes H.

Meanwhile, H of the output signal $Q_{5326}$ acts upon the OR gate 5328 so as to hold the output signal $Q_{5401}$ from the NOR gate 5401 at L and hold the output signal $Q_{5402}$ from the NOR gate 5402 at H. As a result, the AND gate 5403 causes the signal having the frequency 2048 Hz from the frequency divider circuit 2 (FIG. 1) to pass therethrough, thereby starting the counting operation of the counter FF5404 to FF5408.

In the present embodiment, the output signal $Q_{5408}$ from the FF5408 becomes H after the lapse of about 8 m sec. The H signal is supplied through the OR gate 5327 to the NOR gate 5326 so as to make the signal Q5326 L. That is, the signal Q5323 is always held at L and the signal Q5326 becomes an "H" signal having 1 pulse.

If the winding stem 511 is rotated in the left direction so as to produce a signal $(Q_{521})'$, the signals $Q_1$, $Q_2$ become signals as shown in FIG. 5B, respectively. The signal $Q_1$ is reversed in polarity by the inverter 5321 into a signal $Q_{5321}$ which is supplied to the NOR gate 5322. The signal $Q_2$ is directly supplied to the NOR gate 5325. The signal $Q_{5321}$ is earlier in time than the signal $Q_2$ corresponding to the positive pulse of the signal $(Q_{521})'$. As a result, the output signal from the NOR gate 5326 responding to the signal $Q_{5321}$ becomes H at first. The "H" signal is applied through the OR gate 5327 to the NOR gate 5326, thereby holding the output signal $Q_{5326}$ from the NOR gate 5326 at L. As a result, the signal $Q_{5326}$ is held at L even when the signal $Q_2$ becomes H.

The output signal $Q_{5323}$ becomes L after the lapse of about 8 m sec. in the same manner as in the above mentioned case. As the output signals to be supplied to the correction control circuit means 33, the signal $Q_{5326}$ is always held at L and the signal $Q_{5323}$ becomes an "H" signal having 1 pulse.

FIG. 5C shows an example in which a plurality of input signals are supplied to the circuit means 53 from the piezoelectric element 521 when it is driven by the driving ratchet wheel 512 with respect to every one input (K) in the case of rotating the winding stem in the right direction.

If the winding stem 511 and hence the driving ratchet wheel 511 is rotated in the right direction and the piezoelectric element 521 is repelled, the output signal $Q_{521}$ from the piezoelectric element 521 includes oscillation wave forms such as $K_1$ to $K_5$ with respect to the reference level. As a result, the signal $Q_1$ takes a wave form such that $K_2$ and $K_4$ of the signal $Q_{521}$ are held at L. The signal $Q_1$ is reversed in polarity by the inverter 5321 to form a signal $Q_{5321}$. Meanwhile, the signal $Q_2$ takes a wave form such that $K_1$, $K_3$ and $K_5$ of the signal $Q_{521}$ are held at H.

As described with reference to FIG. 5A, the signal $Q_2$ becomes H at a time somewhat earlier in phase than the signal $Q_{5321}$, and as a result, the output signal $Q_{5326}$ from the NOR gate 5326 becomes H at an earlier time. Thus, the output signal $Q_{5323}$ from the NOR gate 5323 is fixed to L, thereby disregarding the signal $Q_{5321}$. In addition, the second, third unrequired "H" signals or the like of the signal $Q_2$ are disregarded.

If the output signal $Q_{5401}$ from the NOR gate 5401 becomes "L" and the output signal Q5402 from the NOR gate 5402 becomes "H", the timer 5404 to 5408 of the timer circuit means 532′ becomes operative to make the output signal $Q_{5408}$ from the FF5408 H after the lapse of about 8 m sec. from the instant at which the signal $Q_{5401}$ is changed to "L".

As a result, the output from the inverter 5412 becomes H and the signal Q5402 becomes L to stop the timers 5404 to 5408. In addition, the signal Q5408 is supplied to the OR gate 5327 to make the signal $Q_{5326}$ L. If the signal $Q_{5408}$ becomes H after the lapse of about 8 m sec., the signal $Q_{5326}$ becomes L. As a result, one of the inputs of the NOR gate 5401 becomes L to bring the NOR gate 5401 into its standby condition. The signal $Q_{5408}$ passes through the inverters 5409 to 5412 with a certain order to time delay. That is, one of the inputs of the NOR gate 5401 becomes L at first and then one of the inputs of the NOR gate 5402 becomes H. As a result, the signal Q5401 is changed into H and the signal Q5402 is changed into L. If the signal Q5401 is changed into H, the timer 5404 to 5408 is reset as to cause the signal $Q_{5408}$ to change into L.

That is, as shown in FIG. 5C, if the winding stem 511 is operated to effect the input operation K two times, two pulses are produced as the output signal $Q_{5326}$ from the NOR gate.

Figure 6:
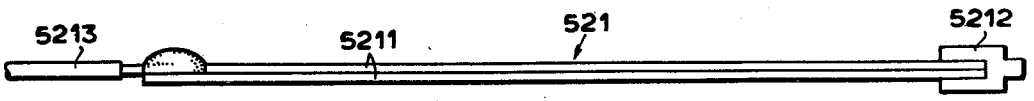
FIG. 6 is a side view of a piezoelectric element of the embodiment shown in FIG. 2.

FIG. 6 shows a construction of a piezoelectric element 521 used in the above mentioned embodiment.

The piezoelectric element 521 comprises a bimorph-shaped oscillation member 5211 formed of barium titanate. A driven member 5212 is formed of brass and secured to the oscillation member 5211. A lead wire 5213 is secured to one of electrodes of the piezoelectric element 521 by soldering. The other electrode directly makes contact with the substrate 100 (FIG. 2) and functions to deliver the signal therefrom.

Figure 7A:
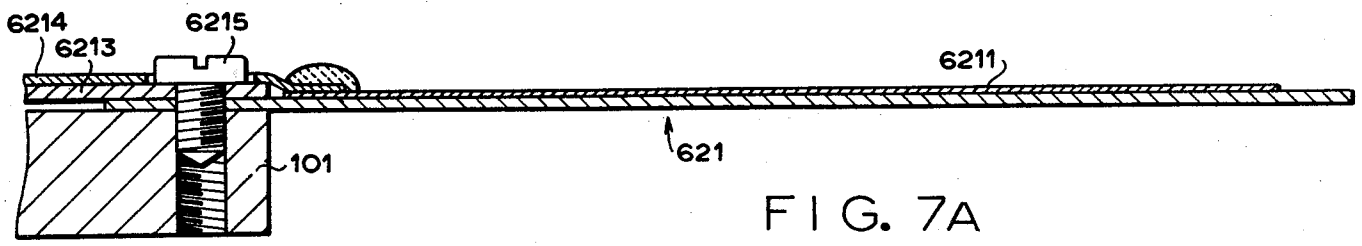
FIG. 7A is a cross-sectional view of another embodiment of a piezoelectric element.
Figure 7B:
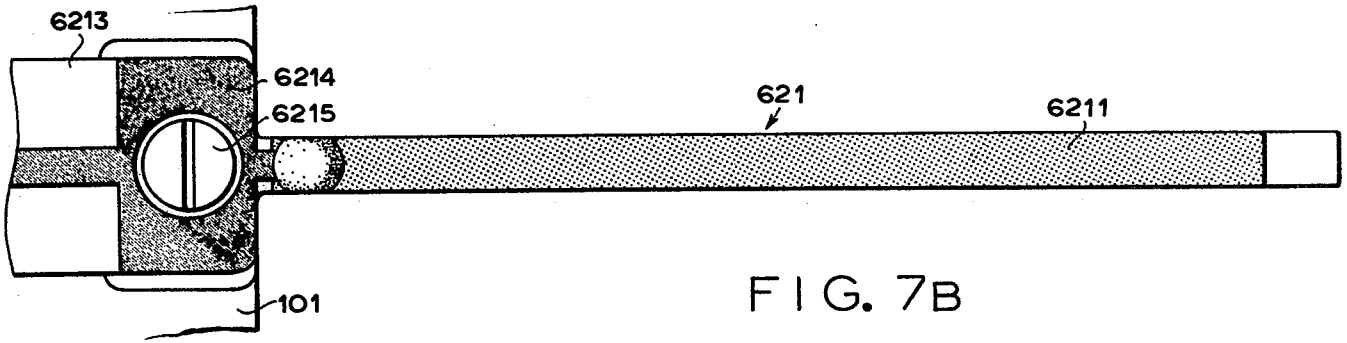
FIG. 7B is its plan view.

FIGS. 7A to 7B show another embodiment of a pizeoelectric element.

In FIGS. 7A and 7B, reference numeral 621 designates a piezoelectric element which comprises an oscillating member 6211 composed of an elastic substrate such, for example, as a stainless steel sheet or a flexible sheet or the like and zirconium titanate vapor deposited on the elastic substrate. On a circuit substrate 6213 formed of a flexible sheet or the like is arranged a wiring pattern having one end secured to the oscillating member 6211 by soldering or the like. The piezoelectric element 621 is directly secured to the substrate 101 by means of a screw 6215.

As stated hereinbefore, the digital input means according to the invention has a number of advantages.

(i) The digital input means according to the invention is very simple in construction if compared with the conventional contact system and provides an input mechanism which is thin and compact.

(ii) In the case of assembling and adjusting the digital input means according to the invention, it is sufficient to merely assemble parts thereof without requiring any adjusting means.

(iii) The use of a mechano-electrical converter element ensures a reliable operation without contacts, thereby obviating troubles due to contacts.

(iv) Use may be made of one lead wire connected to the ground and hence handling can very easily be performed. In addition, the number of lead wires can be reduced by using a signal discriminating means and a rectifier circuit.

(v) In a control circuit means, provision is made of a pair of RS-FF so as to form a preferential order means and fully discriminate input signals.

(vi) The use of a timer circuit means in the control circuit means ensures a removal of unnecessary signals such as chattering produced when the control circuit means is operative.

What is claimed is:

1. A digital input means for miniature type electronic devices comprising:

(a) an oscillator circuit for generating a reference signal;

(b) a frequency divider circuit for generating a unit signal from said reference signal delivered from said oscillator circuit;

(c) a data holding circuit means for generating a driving signal from said unit signal delivered from said frequency divider circuit;

(d) an electro-optical display means for performing a digital display by means of the driving signal delivered from said data holding circuit means;

(e) a piezo-electric element driven by an externally actuating means; and (f) a circuit means for controlling pulses generated by said piezo-electric element, said circuit means being connected to said data holding circuit means for transmitting pulses thereto and said circuit means comprising a signal discriminating circuit means and a control circuit means, whereby said externally actuating means is driven so that said signal discriminating circuit means may discriminate the directions of the pulses generated by said piezo-electric element, and that said control circuit means may shape the pulses, and thereby the pulses being transmitted to the input of said data holding circuit means.

2. The digital input means according to claim 1, wherein control circuit means includes a timer circuit.

* * * * *

UNITED STATES PATENT OFFICE

CERTIFICATE OF CORRECTION

Patent No. 4,336,609 Dated June 22, 1982

Inventor(s) Kazunari Kume and Sizuo Yamaguchi

It is certified that error appears in the above-identified patent and that said Letters Patent are hereby corrected as shown below:

Column 2, line 25, "digitial" should be --digital--.

Column 5, line 19, "is" should be --in--.

Column 7, line 33, "pizeoelectric" should be --piezoelectric--.

Signed and Sealed this

*Twelfth* Day of *October 1982*

[SEAL]

*Attest:*

GERALD J. MOSSINGHOFF

*Attesting Officer* *Commissioner of Patents and Trademarks*